United States Patent [19]

Rehm

[11] 4,226,726

[45] Oct. 7, 1980

[54] DESILTER

[75] Inventor: William A. Rehm, Houston, Tex.

[73] Assignee: Technical Systems Co., Houston, Tex.

[21] Appl. No.: 17,103

[22] Filed: Mar. 5, 1979

[51] Int. Cl.[2] ..... B04C 5/12

[52] U.S. Cl. ..... 210/512 M; 209/211

[58] Field of Search ..... 210/512 R, 512 M; 209/144, 211; 55/413-415

[56] References Cited

U.S. PATENT DOCUMENTS

| | | | |
|---|---|---|---|
| 3,350,852 | 11/1967 | Schindling | 210/512 M X |
| 3,568,847 | 3/1971 | Carr | 210/512 R |
| 3,764,005 | 2/1971 | Zemanek | 210/512 R X |
| 3,817,388 | 6/1974 | Trawinski | 210/512 R X |
| 4,090,523 | 5/1978 | Kelly, Jr. et al. | 210/512 M X |

OTHER PUBLICATIONS

"Corrections of Common Errors in Drilled Solids Removal Systems", George S. Ormsby, A.I.CH.E. meeting, Mar. 1-4, 1971.

"Theory, Applications and Practical Operation of Hydrocyclones", Trawinski, E-MJ,-Sep., 1976.

"Solid-Liquid/Liquid-Liquid Separation Equipment-Centrifuges, Cyclones, Settlers", AICHE meeting, Houston, Texas, Mar. 1-4, 1971.

*Primary Examiner*—William A. Cuchlinski, Jr.

*Attorney, Agent, or Firm*—Neal J. Mosely

[57] ABSTRACT

An improved desilter for drilling muds consists of one or more hydrocyclones with certain features providing for better separation of large particles from the mud. Drilling muds used in drilling oil wells and the like give substantially improved performance when the larger particles are removed therefrom and the mud consists of fine particles having a narrow range of particle size.

An improved hydrocyclone for removing coarser particles from the drilling mud has overflow and underflow outlets which discharge openly rather than into a collection manifold. The overflow outlet is in the form of a controllable syphon which may be adjusted in syphon length or which may include means to adjust the effective length of the syphon leg. The adjustment of the syphon leg controls the overflow of the thin, more uniform mud and effects a superior separation of the larger particles from the mud.

A preferred desilter apparatus comprises a plurality of hydrocyclones, as described, interconnected by an inlet manifold and having underflow and overflow outlets, respectively, for discharge of large particles and of a thin mud of uniform small particle size to separate open collection systems.

17 Claims, 6 Drawing Figures

DESILTER

BACKGROUND OF THE INVENTION

1. Field of the Invention

This invention relates to new and useful improvements in desilters for drilling muds and more particularly to improve hydrocyclones for separating large particles from drilling muds.

2. Brief Description of the Prior Art

Desilting of drilling muds is a necessary step in the preparation of satisfactory muds for the drilling of oil and gas wells. Desilting consists of removing coarse or large particles from a drilling mud so that the remainder of the mud is of a more uniform particle size. The need for desilting and some of the methods of desilting are set forth in papers by George S. Ormsby entitled, "How Proper Desilting Helps in Unweighted Mud Drilling", and "Correction of Common Errors in Drilled Solids Removal Systems."

Desilting, or removal of coarse or large size particles, of drilling muds is commonly accomplished by the use of hydrocyclone separators. Some basic theory on design and operation of hydrocyclones is set forth in "Theory, Applications and Practical Operation of Hydrocyclones", Trawinski, E-MJ-September, 1976; and "Solid-Liquid/Liquid-Liquid Separation Equipment—Centrifuges, Cyclones, Settlers", paper presented at the National AICHE Meeting/Petrochemical and Refining Exposition, Houston, Tex.—Mar. 1-4, 1971.

Several U.S. patents disclose hydrocyclone separators having certain controlled features.

Trawinski, U.S. Pat. No. 3,817,388, discloses hydrocyclone separators having valves controlling the input to the hydrocyclones from a central reservoir and having separate collection systems for the overflow and underflow from the separator.

Zemanek, U.S. Pat. No. 3,764,005, discloses a hydrocyclone separator for pulp in which there are provided valves controlling the input flow and the overflow and a valve controlling the introduction of air into the outlet zone from the separator.

Carr, U.S. Pat. No. 3,568,847, discloses a hydrocyclone separator having an inflatable restriction in the overflow line to control the overflow from the hydrocyclone.

SUMMARY OF THE INVENTION

One of the objects of this invention is to provide a new and improved hydrocyclone apparatus for desilting drilling muds.

Another object of this invention is to provide an improved hydrocyclone desilter for drilling muds having substantially improved separation efficiency for removal of large or coarse particles from such drilling muds.

Still another object of this invention is to provide an improved drilling mud desilter hydrocyclone having an improved controllable overflow which improves substantially separation efficiency.

Still another object of this invention is to provide a new and improved drilling mud desilter hydrocyclone having a controllable syphon effect in the overflow line.

Still another object of this invention is to provide an improved drilling mud desilter apparatus, including a plurality of hydrocyclones interconnected by an inlet manifold and having underflow and overflow outlets discharging into separate open collector systems.

Other objects of this invention will become apparent from time to time throughout the specification and the claims as hereinafter related.

An improved desilter for drilling muds, carrying out the above objectives, consists of one or more hydrocyclones with certain features providing for the better separation of large particles from the mud. Drilling muds used in drilling oil wells and the like give substantially improved performance when the larger or coarser particles are removed therefrom and the mud consists of fine particles having a narrow range of particle size.

An improved hydrocyclone for removing coarser or larger particles from the drilling mud has overflow and underflow outlets which discharge openly rather than into collection manifolds. The overflow outlet is in the form of a controllable syphon which may be adjusted in size and length or which may include means to adjust the effective length of the syphon leg. The adjustment of the syphon leg controls the overflow of the thin, more uniform mud and effects a superior separation of the larger particles from the mud.

A third desilter apparatus comprises a plurality of hydrocyclones, as described, interconnected by an inlet manifold and having an underflow and overflow outlets, respectively, for discharge of large or coarse particles and of a thin mud of uniform small particle size to separate open collection systems.

DESCRIPTION OF THE PREFERRED EMBODIMENT

Figure 1:
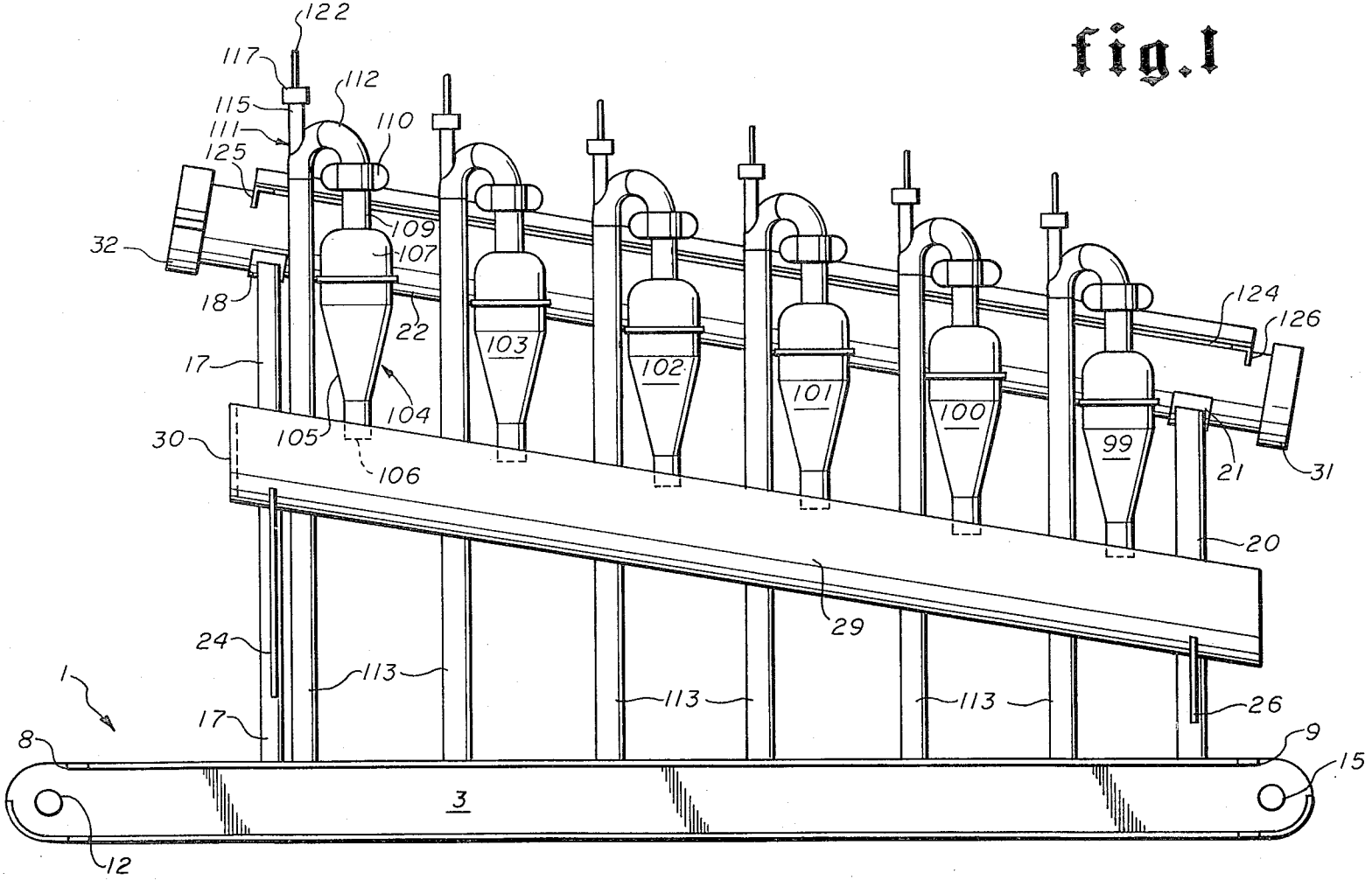
FIG. 1 is a view in side elevation of a bank of hydrocyclones comprising a desilter apparatus which is a preferred embodiment of this invention.
Figure 2:
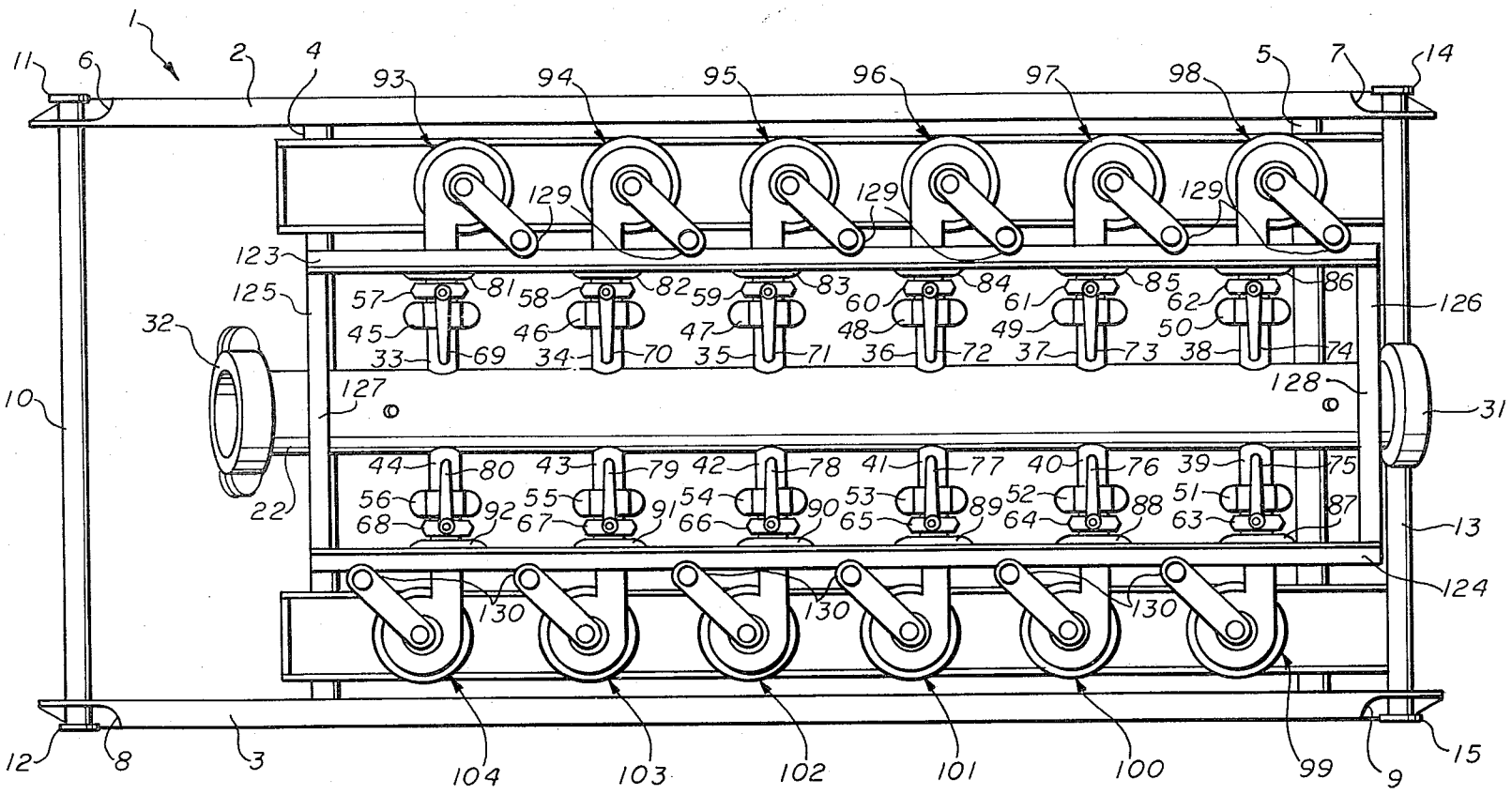
FIG. 2 is a plan view of the desilter apparatus shown in FIG. 1.
Figure 4:
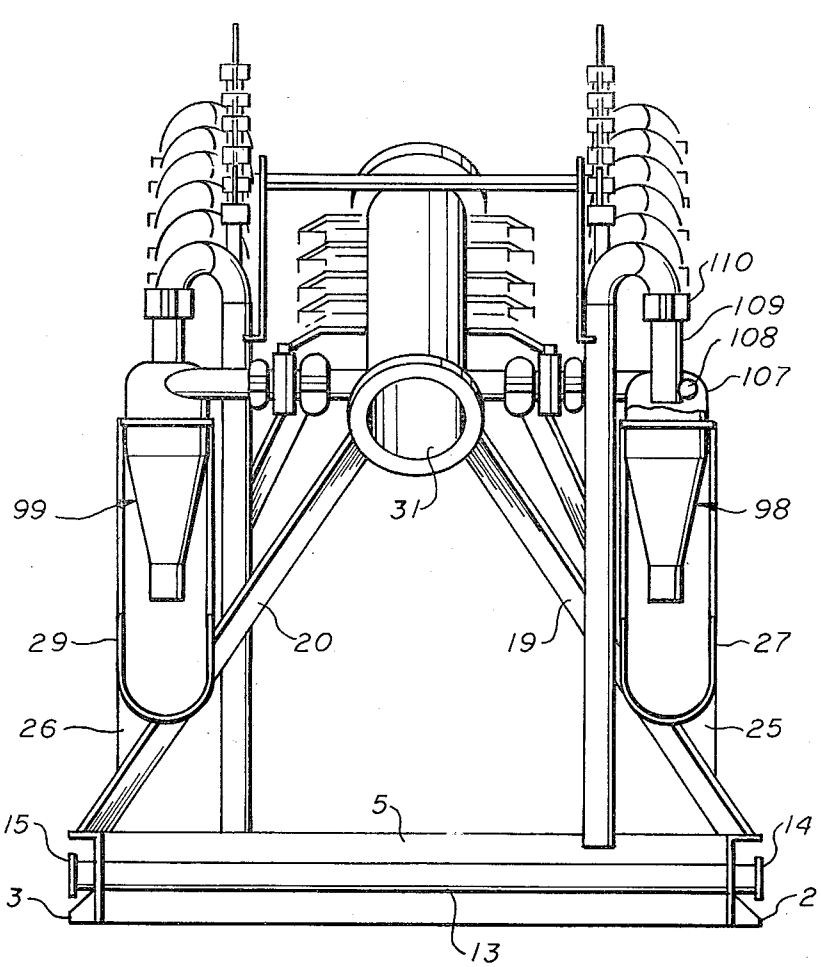
FIG. 4 is a view in right elevation of the desilter apparatus shown in FIG. 1.
Figure 3:
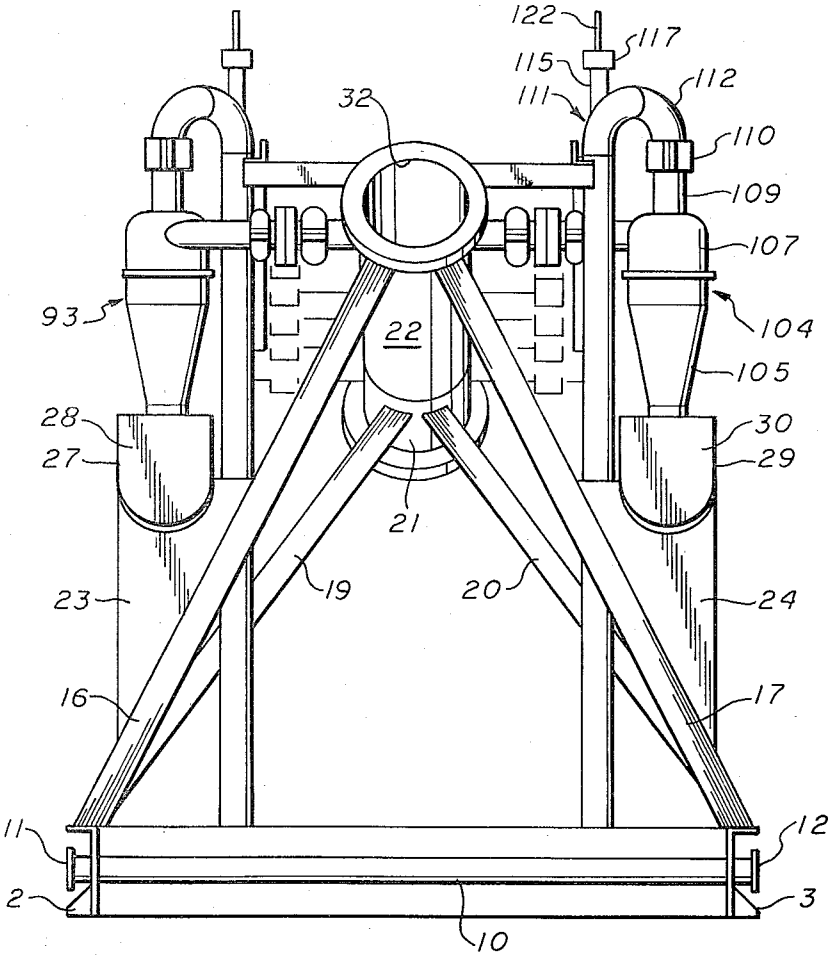
FIG. 3 is a view in left elevation of the desilter apparatus shown in FIG. 1.

In the drawing, there is shown a desilter apparatus for desilting drilling muds which is a preferred embodiment of this invention and which represents the best mode known to applicant for carrying out the invention. The apparatus consists of a plurality of hydrocyclone separators, of novel design, which are interconnected to provide a highly efficient separation of large or coarse particles from a drilling mud. In the drawing, there is shown a bank of twelve hydrocyclone separators, six on each side of a common feed manifold. The apparatus will function with one or more of the novel hydrocyclone separators and the particular number selected for use in the apparatus is a matter of choice or design depending upon the design requirements for the mud system where the desilter is to be used.

In FIGS. 1-4 it is seen that the desilter apparatus has a supporting skid 1 comprising elongated support members 2 and 3, which are shown as channel irons, although any suitable support, such as an I beam or H beam or angle iron could be used. Lateral support members 4 and 5 are secured to between supports 2 and 3. These support members are channels or I beams or H beams or angle irons and are welded to channels 2 and 3 to provide a rigid supporting skid. The ends of channel iron 2 are cut out as indicated at 6 and 7. The ends of channel iron 3 are cut out as indicated at 8 and 9. At the left end of supporting skid 1, a supporting rod 10 extends between channel iron 2 and 3 and has end flanges 11 and 12. At the right end of supporting skid 1, supporting rod 13 extends between channel irons 2 and 3 and has end flanges 14 and 15. The supporting skid is designed so that it can be easily picked up by cables or the like secured to rods 10 and 13 or by any other suitable lifting or transporting equipment.

Skid 1 is provided with a pair of diagonally extending braces 16 and 17 secured at their lower ends to supports 2 and 3, respectively, and at their upper ends to support member 18.

At the other end of Skid 1, diagonal braces 19 and 20 are secured at their lower ends to support members 2 and 3, respectively, and at their upper ends to support member 21. Support members 18 and 21 are semi-cylindrical in shape and support tubular manifold 22. Manifold 22 is secured on support members 18 and 21 against movement, by spot or pack welding or the like.

Support members 16 and 17 have supporting plate members 23 and 24 secured thereon as by welding or the like. Support members 19 and 20 have supporting plate members 25 and 26, respectively, secured thereon as by welding. An open top trough member 27 is supported on plate members 23 and 25 and secured thereto by welding. Trough member 27 is open at the top and at the bottom, discharge end, and has a wall member 28 closing the upper end thereof. A second trough member 29 is supported on plate members 24 and 26 and secured thereon by welding. The top of trough member 29 and the bottom or discharge end thereof are open. The upper end of trough member 29 is closed by an end wall or plate member 30.

Inlet manifold 22 has a flanged closure 31 at its lower end and an open flanged end 32 at its upper end for connection to a pump circulating mud from which larger or coarser particles are to be removed. Manifold 22 is provided with a plurality of side conduits 33–44, inclusive, which support a plurality of hydrocyclone separators which will be described more fully hereinafter. Side conduits 33–44 terminate in snap joints 45–56 which support one side of control valves 57–68, said valves having control handles 69–80, respectively. The other side of control valves 57–68 is connected by snap joints 81–92, respectively, to the inlet side of hydrocyclones 93–104.

The several hydrocyclones 93–104 are identical in construction and are given the same reference numerals for the various component parts thereof. If it is necessary to refer to a particular part of one of the hydrocyclones, it will be identified in terms of the particular hydrocyclone in which it is located. Detailed description of the hydrocyclones will be given with reference to hydrocyclone 104, with the understanding that the other hydrocyclones are constructed and operate in the same manner. Hydrocyclone 104 comprises bottom portion 105 having conically tapered side wall terminating in bottom outlet opening 106. Hydrocyclone 104 has a top or cover portion 107 having a tangential inlet conduit 108 connected to snap joing 92 on control valve 68. Cover member 107 has outlet tube 109 extending outside thereof and also extending concentrically inside to a point at or just below the level of tangential inlet conduit 108. Outlet or overflow tube 109 is connected to snap join 110 which in turn is connected to syphon tube generally designated 111.

Syphon tube 111 includes U-shaped portion 112 and downcomer 113. U tube 112 has an opening 114 aligned substantially concentrically with downcomer leg 113. Vertically extending tube 115 extends upward from opening 114 and is welded to U tube 112 as indicated at 116. Tube 115 is provided with a cover member 117 threaded thereon as indicated at 118 and having a central opening 119. At the upper end of tube 115, and positioned inside cover member 117, is a washer 120 having a central opening 121. Hollow tubing member 122 extends through opening 119 and cover member 117, central hole 121 in washer 120, opening 114 in U tube 112, and concentrically down a substantial portion of the length of downcomer tube 113. Tubing member 122 is of sufficient length to extend to the bottom of downcomer leg 113, which preferably terminates just below the upper edge of the supporting members of supporting skid 1. The tubing member 122 is adjustable vertically to vary the syphon effect is downcomer leg 113 and, thus, optimize the separation of homogeneous drilling mud from coarse or leg particles separated in the hydrocyclone.

The several hydrocyclones 93–104 are positioned with their lower outlet ends 106 extending into collection troughs 27 and 29, respectively. The several downcomer legs 113, which are the overflow outlet tubes from the hydrocyclones are positioned to discharge into the open space at the central portion of supporting skid 1.

The hydrocyclones 93–104 are secured on conduits 33–44 from manifold tubing or conduit 22. The overflow or downcomer tubes 111 are secured against undesired movement or displacement by a frame consisting of angle irons 123 and 124 extending longitudinally of the apparatus and angle irons 125 and 126 extending laterally thereof. The frame is secured together by welding of the angle irons at the four corners thereof. Angle irons 125 and 126 are spot welded to inlet manifold tube 22 as indicated at 127 and 128. Overflow tubes 111 for hydrocyclones 93–98 are welded to supporting frame member 123 as indicated at 129. Overflow tubes 111 from hydrocyclones 99–104 are welded to frame member 124 as indicated at 130.

The desilter apparatus operates on a drilling mud introduced into inlet manifold conduit 22 and is separated by action of the individual hydrocyclones 93–104. The underflow from the individual hydrocyclones discharges into troughs 27 and 29 for removal of coarse material. The homogeneous mud, with coarse particles removed, therefrom, is discharged overhead through overflow conduits 111 into a mud pit or other receptacle, not shown, located below supporting skid 1.

OPERATION

The operation of this apparatus should be generally apparent from the description of construction and assembly thereof. It is necessary, however, for a more thorough understanding of the invention to have a more complete description of operation and, to some extent, an explanation of the theory of hydrocyclone separation.

In oil and gas well drilling, drilling muds are used, and the preparation and treatment of drilling muds has become a major industrial effort. In the use and reuse of drilling mud, it is necessary to maintain a mud composition which is relatively homogeneous. The removal of coarse or large particles from drilling mud is referred to as desilting. Desilted muds are muds which have large or coarse particles removed therefrom so that the mud is formed of clay solids which are fine particles size and relatively uniform in size distribution. A desilted mud is not a low solids mud and may not be produced by mere dilution of a mud which is too thick or has too high solids content. Coarser solids are removed from a drilling mud in a desilting operation to give a more homogeneous and more easily handled mud which is needed for a variety of purposes.

The separation of coarse or large particles from a drilling mud may be accomplished by a variety of separatory techniques. Separation of coarse particles can be accomplished to a limited extent by use of a separation basin wherein the particles merely settle out. A more efficient separation may be accomplished in a rotary separator such as a centrifuge. A hydrocyclone functions somewhat similarly to a centrifuge in that the feed stock is rotated and the particles of larger size thrown to the outside by centrifical force.

Figure 5:
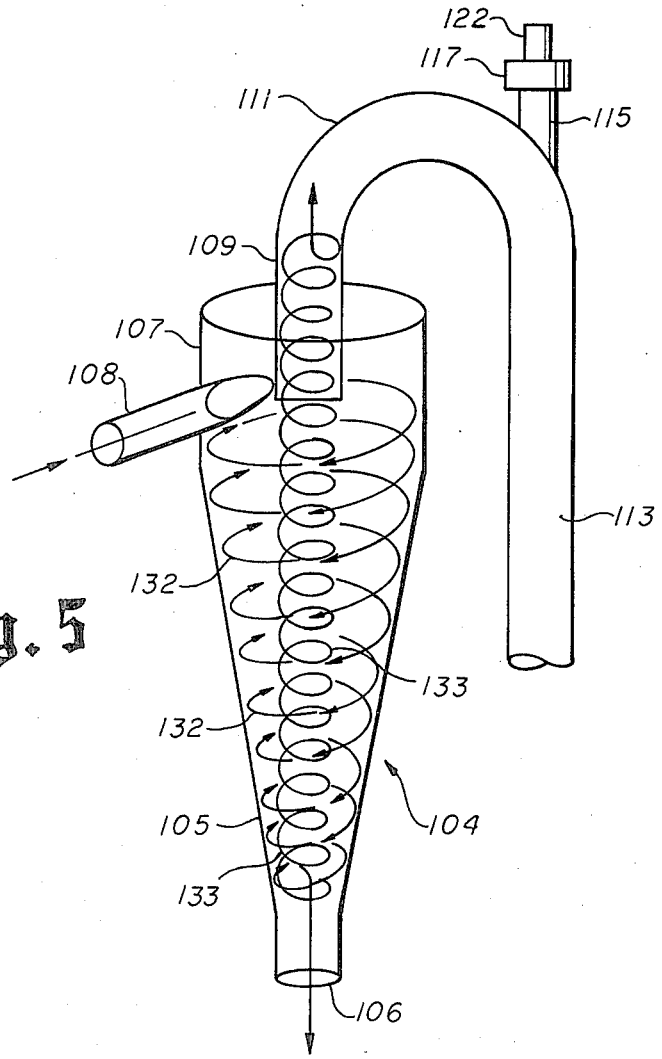
FIG. 5 is an isometric, detail view of one of the hydrocyclones illustrating the flow of materials.
Figure 6:
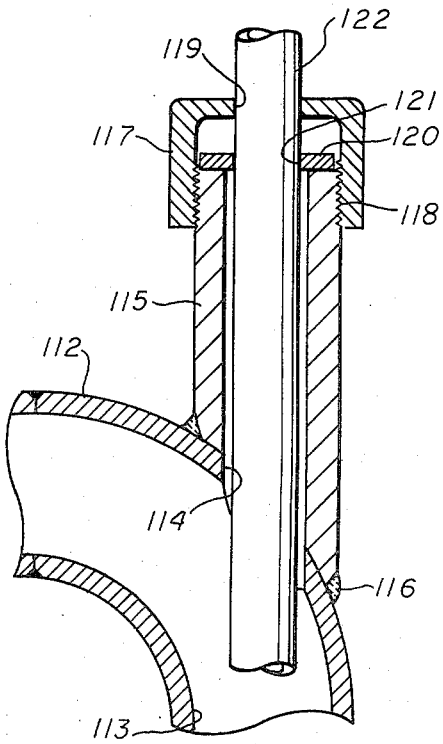
FIG. 6 is a detail view, partially in section, of the adjustable syphon on the overflow line from the various hydrocyclones.

The operation of a hydrocyclone is shown, somewhat schematically in FIG. 5 of the drawing. A pressurized slurry, i.e., drilling mud, is introduced through tangential inlet conduit 108. The slurry circulates around the wall of the hydrocyclone and moves downward in a spiral pattern as indicated by lines 132. As the slurry circulates around the conical wall of the hydrocyclone separator and moves downward in a spiral path, it rotates faster and faster as the diameter of the hydrocyclone tapers to a smaller and smaller amount. During this centrifical movement, the coarser solids in the slurry, i.e., drilling mud, are thrown outward by centrifical force to the wall of the hydrocyclone separator and move downward with the flow of fluid. At the bottom of the separator, the flow of circulating fluid stops and begins to move upward inside the outer rotating fluid as indicated by lines 133. At the point of reversal of flow, where the fluid begins to flow upward, at the bottom of the separator, the solids drop out and fall out through opening 106 into collection trough 27 or 29. A fluid flowing upwardly through the center of the separator in the path indicated by lines 133 is removed overhead through outlet tube 109. It should be noted that the upward spiraling vortex of mud freed from the coarser particles continues its spiral movement up into the lower end of outlet tube 109. The desilted mud is removed from outlet tube 109 through overflow tube 111 and discharged to a mud pit or other container or reservoir. More details on the theory of hydrocyclone operation may be found in the papers referred to in the BACKGROUND OF THE INVENTION.

In the past, banks of hydrocyclone separators have been constructed for use in drilling mud desilting and for other separatory purposes. Such banks of separators have almost always had inlet manifold conduits providing a common feed supply to the several hydrocyclone separators. In addition, the overflow conduits and the underflow outlets from the several hydrocyclone separators have been connected to separate closed discharge manifold systems. This has been considered necessary for maximum separation efficiency.

In the development of this invention, it was found that superior separation efficiency is obtained in a bank of hydrocyclone separators by separating the outlet discharge connections from any common enclosed manifold collecting system. It has been found that if the underflow outlets discharge into a collecting system separately, with the entire system maintained open to the atmosphere and if the overflow outlet conduits discharge separately at atmospheric pressure directly to a collection pit or reservoir, a substantially improved separation efficiency is obtained. This improvement in performance is believed to be due to the need for a balanced pressure drop through individual ones of the hydrocyclone separators which is not possible when they are connected with the inlet and all of the outlets opening into enclosed collection or supply manifolds. In addition, it has been found that a substantial improvement in separation efficiency can be obtained by an adjustment of a syphon effect in the overflow from the individual hydrocyclone separators.

In the preferred embodiment of this invention shown in the several drawings, it should be noted that only the inlet flow is through an enclosed manifold system. The underflow from the outlet ends 106 of the several hydrocyclones discharges into open collection troughs so that the discharge is to atmospheric pressure and not to a pressure defined by the flow characteristics in an enclosed outlet connection manifold. Likewise, the overflow conduits are arranged to discharge directly and independently at atmospheric pressure to an open collection reservoir. Each of the overflow tubes 111 is provided with an adjustable syphon controlling tube 122 which may be adjusted in position to set the syphon effect at the desired level for each individual hydrocyclone separator to obtain maximum separating efficiency. It has been found that the maximum separating efficiency is obtained by varying the syphon effect in the outlet tubes 111 and establishing a pre-determined value for each of the several hydrocyclones. This results in maintaining a pre-selected desired pressure at the inlet end of outlet tube 109 which maintains the desired rate of centrifical movement of the slurry in the hydrocyclone separator to effect a maximum degree of separation of coarse or large particles. The adjustment in syphon effect could be accomplished for any particular mud composition by experimental determination of the desired amount of syphon-induced suction and cutting off the downcomer conduit 113 for each hydrocyclone separator to a predetermined length producing the desired amount of suction. This would require a pre-selected length for the downcomer conduits 113 for each of the separate hydrocyclones and would optimize the separating efficiency for the particular mud composition used in the apparatus. It is obvious, however, that a desilting apparatus is likely to be used on mud compositions which vary substantially in composition and texture. As a result, it is desirable to have some means for independent variation or adjustment of the syphon effect in the downcomer legs or conduits 113. This is accomplished by the independently adjustable tubes 122 which can be adjusted to locate their lower ends at any selected height within the downcomer leg or conduit 113. The tubes 122 are open at their upper ends to atmospheric pressure and their lower ends determine the point at which the syphon effect breaks in the outlet or downcomer tubes 113. This independent adjustment of the syhon effect in the overflow from the individual hydrocyclones makes it possible to maximize the separation efficiency of the hydrocyclones. It has been found in the past that banks of hydrocyclone separators used in drilling mud desilting operate at only a 15–25% efficiency. This apparatus, constructed and operated as described, is operated at separation efficiencies of the order of 50–75%.

While this invention has been described fully and completely with special emphasis upon a single preferred embodiment it should be understood that within the scope of the appended claims, the invention may be practiced otherwise and as specifically described herein.

I claim:

1. A desilter for drilling muds comprising a common inlet manifold conduit and a plurality of hydrocyclone separators arranged in two parallel rows in series along said conduit and connected thereto, each of said hydrocyclone separators comprising a hollow, enclosed vessel, having an upper, large casing portion with a tangential side inlet opening and conduit extending therefrom and an outlet conduit extending out through the upper wall thereof, and a lower casing portion tapering downwardly from said upper casing portion and defining a downwardly extending conical chamber having a bottom outlet for discharge of separated materials therefrom, supporting means for said separators, said inlet manifold conduit being supported on said supporting means and having a plurality of conduit means positioned serially thereon connecting the same to respective tangential inlet conduits on said separators, at least one collection trough open to atmosphere at the top and positioned below said separators to receive the discharge of material from the bottom outlets therefrom, and individual syphon conduits for each of said outlet conduits having outlet ends discharging separately to a collection point at atmospheric pressure.

2. A desilter according to claim 1 in which said separators are supported in a line in decreasing elevation, said inlet manifold conduit is supported on a slope substantially the same as said separators, and said collection trough is supported on a slope substantially the same as said separators and with the bottom ends of said separators extending into the upper top portion thereof.

3. A desilter according to claim 2 in which said supporting means is a rectangular open frame, and said syphon conduits are positioned with the outlet ends thereof extending inside the open central portion of said frame and terminating just below the upper edge thereof.

4. A desilter according to claim 1 in which said syphon conduits each have effective syphon lengths predetermined for optimum separation efficiency.

5. A desilter for drilling muds comprising a plurality of hydrocyclone separators, each of said hydrocyclone separators comprising a hollow, enclosed vessel, having an upper, large casing portion with a tangential side inlet opening and conduit extending therefrom and an outlet conduit extending out through the upper wall thereof, and a lower casing portion tapering downwardly from said upper casing portion and defining a downwardly extending conical chamber having a bottom outlet for discharge of separated materials therefrom, supporting means for said separators, an inlet manifold conduit supported on said supporting means and having conduit means connecting the same to respective tangential inlet conduits on said separators, at least one collection trough open to atmosphere at the top and positioned below said separators to receive the discharge of material from the bottom outlets therefrom, individual syphon conduits for each of said outlet conduits having outlet ends discharging separately to a collection point at atmospheric pressure, and said syphon conduits being separately adjustable in effective syphon length for independent adjustment of said separators.

6. A desilter according to claim 5 in which said syphon conduits include means to vary the effective syphon length thereof.

7. A desilter according to claim 6 in which said syphon conduit length-varying means comprises an adjustably movable conduit having one end open to atmosphere and the other end positioned movably inside said syphon conduit.

8. A desilter according to claim 7 in which said syphon conduit comprises an elbow secured on said outlet conduit from said separator and a straight, downwardly extending conduit extending substantially below the outlet end of said separator, said elbow having an opening aligned with said downwardly extending conduit, a conduit secured on said elbow at said opening and aligned with said downwardly extending conduit, a cap secured on said elbow conduit and having a centrally located opening, and said adjustably movable conduit being positioned with one end outside said cap and extending therethrough and into said downwardly extending conduit and movable longitudinally therein to vary the syphon length thereof.

9. A desilter for drilling muds comprising, a plurality of hydrocyclone separators supported in a line in decreasing elevation, each of said hydrocyclone separators comprising a hollow, enclosed vessel, having an upper, large casing portion with a tangential side inlet opening and conduit extending therefrom and an outlet conduit extending out through the upper wall thereof, and a lower casing portion tapering downwardly from said upper casing portion and defining a downwardly extending conical chamber having a bottom outlet for discharge of separated materials therefrom, supporting means for said separators, an inlet manifold conduit supported on said supporting means on a slope substantially the same as said separators and having conduit means connecting the same to respective tangential inlet conduits on said separators, at least one collection trough open to atmosphere at the top and positioned below said separators to receive the discharge of material from the bottom outlets therefrom, said collection trough being supported on a slope substantially the same as said separators and with the bottom ends of said separators extending into the upper top portion thereof, individual syphon conduits for each of said outlet conduits having outlet ends discharging separately to a collection point at atmospheric pressure, and said syphon conduits each having effective syphon lengths predetermined for optimum separation efficiency.

10. A desilter according to claim 9 in which said syphon conduits are separately adjustable in effective syphon length for independent adjustment of said separators.

11. A desilter according to claim 10 in which said syphon conduits include means to vary the effective syphon length thereof.

12. A desilter according to claim 11 in which said syphon conduit length-varying means comprises an adjustably movable conduit having one end open to atmosphere and the other end positioned movably inside said syphon conduit.

13. A desilter according to claim 12 in which said syphon conduit comprises an elbow secured on said outlet conduit from said separator and a straight, downwardly extending conduit extending substantially below the outlet end of said separator, said elbow having an opening aligned with said downwardly extending conduit, a conduit secured on said elbow at said opening and aligned with said downwardly extending conduit, a cap secured on said elbow conduit and having a centrally located opening, and said adjustably movable conduit being positioned with one end outside said cap and extending therethrough and into said downwardly extending conduit and movable longitudinally therein to vary the syphon length thereof.

14. A hydrocyclone separator comprising, a hollow elongated enclosed vessel, said vessel having an upper large casing portion with a tangential side opening and a centrally located top opening, an inlet conduit connected to said upper casing portion at said tangential inlet opening, an overflow conduit extending concentrically of said upper casing portion through said top opening and having one end open inside said upper casing portion at a point below said tangential inlet opening and another end extending outside said top opening.

a lower casing portion secured to said upper casing portion and tapering downward therefrom to provide a downwardly extending conical chamber and having a bottom opening for discharge of separated material therefrom, and a syphon conduit, adjustable in effective syphon length, connected to and secured on the outside end of said overflow conduit.

15. A hydrocyclone separator according to claim 14 in which said syphon conduit includes means to adjust the syphon length thereof.

16. A hydrocyclone separator according to claim 15 in which said syphon conduit length-varying means comprises an adjustably movable conduit having one end open to atmosphere and the other end positioned movably inside said syphon conduit.

17. A hydrocyclone separator according to claim 16 in which said syphon conduit comprises an elbow secured on said outlet conduit from said separator and a straight, downwardly extending conduit extending substantially below the outlet end of said separator, said elbow having an opening aligned with said downwardly extending conduit, a conduit secured on said elbow at said opening and aligned with said downwardly extending conduit, a cap secured on said elbow conduit and having a centrally located opening, and said adjustably movable conduit being positioned with one end outside said cap and extending therethrough and into said downwardly extending conduit and movable longitudinally therein to vary the syphon length thereof.

* * * * *